United States Patent [19]

Narumi et al.

[11] 3,967,440

[45] July 6, 1976

[54] DEVICE FOR CUTTING A TAIL-END OF A YARN PACKAGE FORMED ON A BASE PORTION OF EACH SPINDLE IN A TEXTILE MACHINE

[75] Inventors: Akio Narumi, Obu; Shuji Takahisa, Toyota; Masanao Kobayakawa, Anjyo; Yoshihal Fujimoto, Kariya, all of Japan

[73] Assignee: Kabushiki Kaisha Toyoda Jidoshokki Seisakusho, Japan

[22] Filed: Dec. 27, 1974

[21] Appl. No.: 536,750

[30] Foreign Application Priority Data

Dec. 27, 1973 Japan ..... 49-298[U]

[52] U.S. Cl. ..... 57/34 TT; 57/54; 57/131; 242/18 EW

[51] Int. Cl.[2] ..... D01H 1/38

[58] Field of Search ..... 57/34 TT, 54, 131; 242/18 PW, 18 EW

[56] References Cited

UNITED STATES PATENTS

| | | | |
|---|---|---|---|
| 3,210,922 | 10/1965 | Winter | 57/54 |
| 3,283,489 | 11/1966 | Bakker | 57/34 TT |
| 3,321,901 | 5/1967 | Adams et al. | 57/131 |
| 3,339,356 | 9/1967 | Nikel et al. | 57/34 TT |
| 3,490,218 | 1/1970 | Naegeli | 57/34 TT |
| 3,530,657 | 9/1970 | Grau | 57/34 TT |
| 3,731,479 | 5/1973 | Flowers et al. | 57/131 |

*Primary Examiner*—John Petrakes
*Attorney, Agent, or Firm*—Paul & Paul

[57] ABSTRACT

An improved device for cutting a tail-end yarn portion connecting a spiral wind formed on a yarn package and a tail-end winding formed on a base portion of each spindle of a textile machine, at the time of carrying out the doffing operation. A cutting device is mounted on a base portion of each spindle and a bobbin is supported by the spindle at a position right above the cutting device. The cutting device is provided with a ring shaped cutter and a guide member for holding the cutter and a crip member formed right below the guide member. The diameter of the guide member is larger than the diameter of the crip member and the guide member is provided with at least one cut-out groove, preferably a plurality of cut-out grooves, formed at the circumferential portion thereof so that a part of a knife edge of the cutter is projected outside therefrom but positioned within the outer-periphery of the guide member. When a ring rail of the textile machine is displaced to its lower most position the tail-end yarn portion is caught by the cut-out groove of the guide member and is urged against the knife edge of the cutter while displacing along the knife edge, and then cut.

5 Claims, 10 Drawing Figures

DEVICE FOR CUTTING A TAIL-END OF A YARN PACKAGE FORMED ON A BASE PORTION OF EACH SPINDLE IN A TEXTILE MACHINE

SUMMARY OF THE INVENTION

The present invention relates to an improved device for automatically cutting a tail-end of a yarn package formed on a base portion of each spindle of a textile machine, when the yarn packages are doffed from the respective spindles.

It is well known that, when yarn packages of full size are doffed from the respective spindles of a textile machine, such as a ring spinning frame or twisting machine, the ring rail is firstly displaced to its lowermost position so as to form a tail-end winding on a base portion of each spindle of the textile machine. Next the yarn packages are doffed from the respective spindles in such a condition that a yarn portion connecting the yarn package and the tail-end winding is cut.

To carry out the above-mentioned cutting operation, several cutting devices have been introduced. However, it is our opinion that these conventional cutting devices are not acceptable because perfect cutting of the yarn is not always achieved. For example if a cutting device utilizing a cutting principle based on severing is used to carry out the cutting operation on a textile machine producing a yarn package of a synthetic filament, the filament yarn is elongated by the severing action and it is impossible to cut the filament yarn perfectly. Further, in the case of utilizing a cutting device provided with a knife edge cutter, if the yarn material of the yarn package is a synthetic filament, since the cutting operation is carried out by contacting the yarn against the knife edge in an angular contacting condition, perfect cutting of the filament yarn is frequently not accomplished.

The principal object of the present invention is to provide an improved device for cutting a connection between a yarn package and a tail-end winding package, formed on a base portion of each spindle of a textile machine, which eliminates the above-mentioned drawbacks of a conventional cutting device.

Another object of the present invention is to provide an improved device for cutting a connection between a yarn package and a tail-end winding formed on a base portion of each spindle, wherein a replaceable cutter is positioned.

To attain the purpose of the present invention, the cutting device according to the present invention is provided with a guide member having at least one recess for restricting the yarn passage between the yarn package and the tail-end winding, in such a condition that the yarn passage is at an inclined angle to a spindle shaft, and a cylindrical crip member, for forming a tail end yarn portion thereon is formed at a base portion of the spindle at a position below the above-mentioned guide member. The cylindrical crip member is provided with a knurled cylindrical surface and a ring shaped cutter is replaceably mounted on the above-mentioned guide member in stable condition.

DETAILED EXPLANATION OF THE INVENTION

Figure 1:
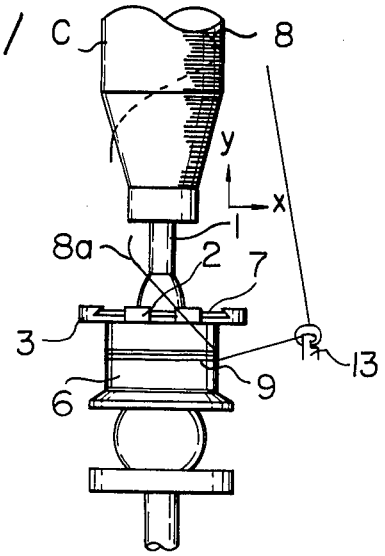
FIG. 1 is a schematic front view of a cutting device mounted on a spindle according to the present invention.
Figure 3:
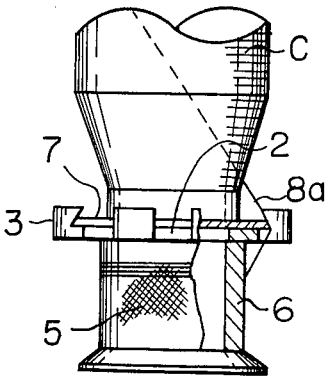
FIG. 3 is a schematic front view of the cutting device, partly in section, shown in FIG. 1.
Figure 4:
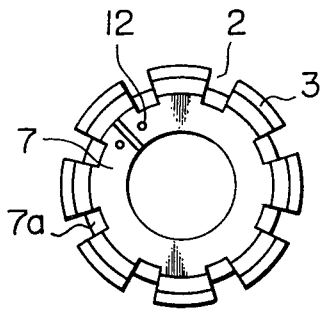
FIG. 4 is a schematic plan view of the cutting device mounted on the spindle according to the present invention.
Figure 5:
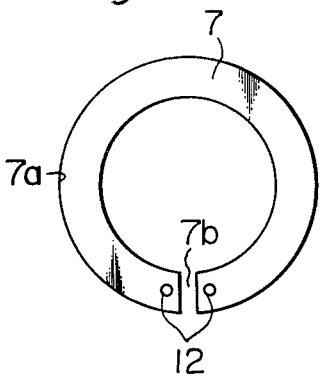
FIG. 5 is a schematic plan view of a ring shaped cutter utilized for the cutting device shown in FIG. 1.
Figure 6:
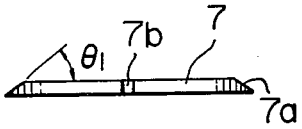
FIG. 6 is a schematic side view of the ring shaped cutter shown in FIG. 5.
Figure 7:
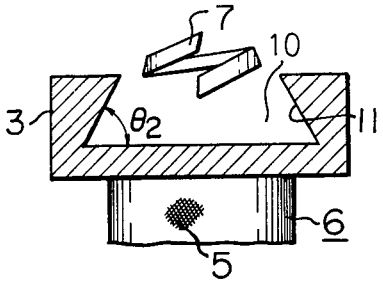
FIGS. 7 and 8 are explanatory front views of the cutting device according to the present invention when the ring shaped cutter shown in FIGS. 5 and 6 is mounted thereon.
Figure 8:
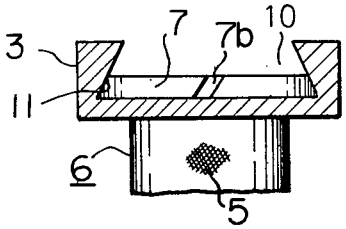

Referring to FIGS. 1, 2, 3, 4, 5, 6, 7 and 8, the cutting device according to the present invention comprises a round guide member 3 mounted on a base portion of a spindle 1, a cylindrical crip member 6 coaxially secured to the spindle 1 at a position right below the guide member 3 and a thin ring shaped cutter 7 coaxially mounted on the guide member 3. The cutter 7 is provided with a circular knife edge 7a as shown in FIGS. 4, 5 and 6. The point angle of this knife edge is represented by $\theta_1$ in FIG. 6. The crip member 6 is provided with a knurled surface 5 and the diameter of the crip member 6 is smaller than the diameter of the guide member 3. The knurled surface 5 of the crip member 6 permits the winding of the tail end of a yarn thereon. The guide member 3 is provided with a round recess 10 which is capable of receiving the ring shaped cutter 7 therein. To hold the cutter 7 in the round recess 10 in a stable condition, an inside wall 11 of the recess 10 is inclined inward from the bottom of the recess 10 to the top edge of the recess 10. That is, the inside wall 11 is tapered toward the inside of the round recess 10 from the bottom of the recess 10 to the top edge of the recess 10 with a taper angle $\theta_2$. To hold the cutter 7 in the recess 10 of the guide member 3 in a secured condition, it is preferable to form the point angle $\theta_1$ of knife edge of the cutter 7 in such a condition that the angle $\theta_1$ is substantially identical to the taper angle $\theta_2$.

In this embodiment of the cutting device, a plurality of cut-out grooves 2 are formed at the circumferential wall of the guide member 3 so as to project the knife edge *7a* of the cutter 7 from the recesses 2 as shown in FIG. 4. According to our experimental texts, it was found that the intervening distance between two adjacent cut-out grooves 2 must be defined so as to permit acceptance therein of a straight yarn portion of a connection between a yarn package *c* and a tail end winding 9, when the ring rail (not shown) is displaced to its lowermost position at the time of carrying out the doffing operation.

Further, the knurled surface 5 of the cylindrical crip member 6 effectively prevents slipping of a tail-end winding of a yarn, which forms thereon, along the cylindrical surface of the crip member 6 so that the tail end of the yarn is tightly wound on the cylindrical crip member 6. Consequently, the straight portion of the tail-end yarn can be urged to the sharp knife edge of the cutter 7 and cut thereby.

The function of the cutting device according to the present invention is hereinafter explained in detail, with reference to the above-mentioned drawings.

When a full size yarn package *c* is formed on each spindle 1 of a textile machine such as a ring spinning frame or ring twisting frame, firstly, a ring rail 13 is displaced to its lowermost position while each spindle 1 is rotating by its inertia. According to the above-mentioned displacement of the ring rail 13, a spiral winding of yarn is formed on the yarn package *c* and the tail-end winding 9 is formed on the crip member 6 of the cutting device so that a straight yarn portion 8*a* is formed along a passage between the bottom end of the spiral winding of yarn on the yarn package *c* and the tail-end winding 9 in such a way that the straight yarn portion 8*a* passes through one of the above-mentioned cut-out grooves 2. When the straight portion 8*a* of the tail end yarn is introduced into the cut-out groove 2, the straight portion 8*a* is urged to the knife edge of the cutter 7 in an inclined condition to the cutting edge. Further, since the outside diameter of the cylindrical portion of the crip member 6 is smaller than the yarn guide member 3, the above-mentioned yarn portion 8*a* of the tail-end yarn between the yarn package *c* and crip member 6 is maintained in a straight condition and the yarn is forced to knife edge of the cutter 7.

Figure 2:
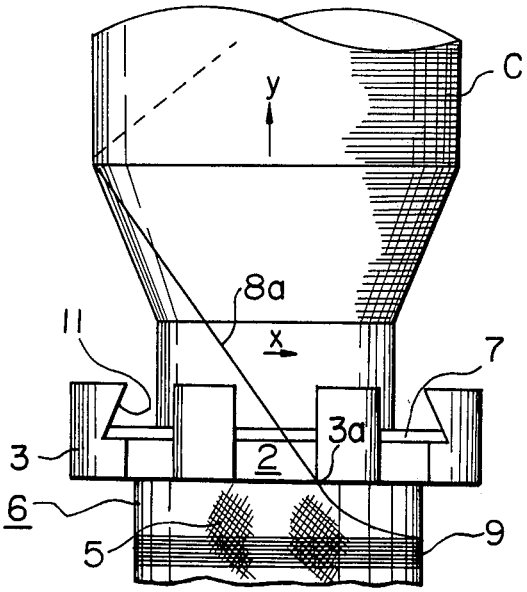
FIG. 2 is an enlarged front view of the cutting device shown in FIG. 1.

When the full size yarn package *c* is taken from the respective spindles 1, since the yarn package *c* is displaced upward, the yarn portion 8*a*, which extends between the spiral winding of the yarn package *c* and the tail-end yarn winding 9 wound on the crip portion 6, is laterally displaced toward the *x* direction shown in FIG. 2. During the above-mentioned lateral displacement of the straight yarn portion 8*a*, since a yarn portion adjacent to the tail-end winding 9 engages the bottom edge 3*a* of the cut-out groove 2, the yarn portion 8*a* is turned around the bottom edge 3*a* and, consequently, the yarn portion 8*a* is displaced toward the *x* direction while being urged against the knife edge of the cutter 7. In this condition, the yarn portion 8*a* is by the knife edge 7*a* bent as shown in FIG. 3, while, the free lateral displacement of the yarn portion 8*a* is restricted by the bottom edge 3*a* of the cut-out groove 2. Accordingly, a very effective shearing force is applied to the yarn portion 8*a* so that the cutting of the straight yarn portion 8*a* can be carried out perfectly. To create the above-mentioned very effective shearing force, the relative position and size of the guide member 3 to the crip member 6 is an important factor. That is, it is necessary that the guide member 3, having a laterally larger size than the crip member 6, be mounted at a position right above the crip member 6. Further it is necessary to stably hold the cutter 7 on the guide member 3 in a replaceable condition. This is because, if the knife edge 7*a* of the cutter 7 is worn during a long period of utilization thereof, the used cutter 7 should be replaced by a fresh cutter 7.

Referring to FIGS. 4, 5, 6, 7 and 8, the cutter 7 is a ring shaped one provided with a cut-out portion 7*b* and, therefore, the cutter 7 is capable of contracting radially. According to the above-mentioned construction of the cutter 7, when the cutter 7 is mounted on the guide member 3, the cutter 7 is radially contracted and inserted into the recess 10 of the guide member 3 in such a way that the cutter 7 contacts the inside wall 11 of the recess 10. When the above-mentioned insertion is completed, the cutter 7 is expanded radially so that the cutter 7 is stably held by the inside wall 11 of the recess 10. To attain very effective holding of the cutter 7 by the guide-member 3, the inside wall 11 of the recess 10 is formed in such a condition that the radial space defined by the inside wall 11 decreases toward the upward direction, in other words, the recess 10 is formed in a conical shape having a smaller top portion and a larger bottom portion. In this condition, a ring shaped groove is formed between the inside wall 11 and the bottom plane of the recess 10. This ring shaped groove is provided with a tapered side wall which is the above-mentioned inside wall 11. If the taper angle of the above-mentioned tapered side wall is identical to the point angle $\theta_1$ of the knife edge 7*a* of the cutter 7, the cutter 7 can be held by the above-mentioned ring shaped groove in a very stable conditon.

When it is required to take-out the cutter 7 from the recess 10 of the guide member 3, the ring shaped cutter 7 is firstly radially contracted and then taken from the recess 10 of the guide member 3. To carry out the above-mentioned taking-out operation very easily, a pair of small apertures 12 are formed in the cutter 7 as shown in FIG. 5. In this embodiment, an auxiliary device for contracting the cutter 7 is utilized. This auxiliary device is a tool similar to a pinchers, provided with a pair of projections which can be inserted into the above-mentioned small apertures 12, respectively. When the cutter 7 is taken-out of the recess 10 of the guide member 3, the above-mentioned projections of the auxiliary device are inserted into the small apertures 12 of the cutter 7, respectively, the distance between the projections is forced to decrease by operating the auxiliary device and, then, the cutter 7 is taken from the recess 10 of the guide member 3.

Figure 9:
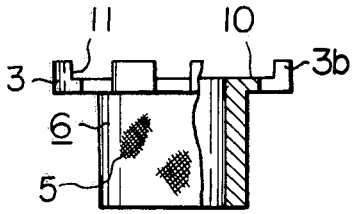
FIGS. 9 and 10 are explanatory front views of another type of cutting devices according to the present invention.
Figure 10:
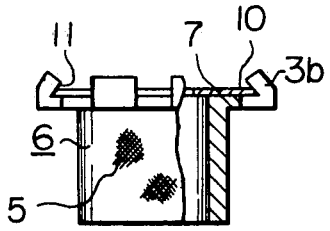

The above-mentioned conical recess 10 of the guide member 3 can be easily made by the conventional molding operation, if a plastic material is utilized for making the guide member 3. If a metallic material is used for the guide member 3, the following step for forming the recess 10 of the guide member 3 may be applied. Referring to FIGS. 9 and 10, the cylindrical recess 10 is firstly formed in the guide member 3 in such a condition that a plurality of thin upwardly projected edge portions 3*b* are formed (FIG. 9). After mounting the cutter 7 into the recess 10, these edge portions 3*b* are bent inward so as to hold the cutter 7 by the edge portions 3*b* as shown in FIG. 10. If the cutter 7 is made from an elastic material, a perfectly round ring cutter may be utilized, because, such cutter can be mounted on or taken from the guide member 3 without difficulty due to its elasticity.

What is claimed is:

1. In a device for cutting a tail-end yarn portion connecting a spiral wind formed on a yarn package and a tail-end winding formed on a base portion of each spindle of a textile machine, which supports said yarn package, at a time of carrying out the doffing operation, an improvement comprising a cylindrical crip member coaxially mounted on said base portion of each spindle for forming said tail-end yarn portion thereon, a guide member coaxially formed on said crip member and a ring shaped cutter incased in said guide member, said guide member provided with an upwardly opened ring shaped recess thereon for stably receiving said cutter and a plurality of cut-out grooves formed at a circumferential edge portion thereof, said cutter provided with a sharp knife edge formed at a circumferential side thereof and a part of said knife edge projected upward from a bottom surface of each said cut-out groove of said guide member, but positioned within the outer-periphery of said guide member, said crip member provided with a knurled surface, the diameter of said guide member being sufficiently larger than the diameter of said crip member so that said tail-end yarn portion is capable of sliding on said knife edge of said cutter at anyone of said cut-out grooves of said guide member under tensioned condition when said yarn package is taken from said spindle.

2. An improved cutting device according to claim 1, wherein said ring shaped cutter is provided with a partly cut-out portion so that said cutter is capable of radial contraction when said cutter is inserted into said recess of said guide member.

3. An improved cutting device according to claim 1, wherein said recess of said guide member is a conical recess provided with a small top and a larger bottom so that an inwardly tapered inside wall is formed.

4. An improved cutting device according to claim 1, wherein said recess of said guide member is a cylindrical recess so that a cylindrical outside wall is formed, said cylindrical outside wall is provided with said cut-out grooves, said outside wall is bent slightly inward after mounting said cutter in said recess, whereby said cutter is stably held by said outside wall of said guide member and a part of the knife edge of said cutter is projected from each said cut-out groove but positioned within the outer-periphery of said guide member.

5. An improved cutting device according to claim 4, wherein said ring shaped cutter is provided with a partly cut-out portion so that said cutter is capable of radial contraction when said cutter is inserted in said recess of said guide member.

* * * * *